United States Patent [19]

Mehan

[11] Patent Number: 5,023,982

[45] Date of Patent: Jun. 18, 1991

[54] SHOE LACE FOR ATHLETIC SHOES

[76] Inventor: Charles T. Mehan, 1949 N. 11th St., Sheboygan, Wis. 53081

[21] Appl. No.: 465,805

[22] Filed: Jan. 16, 1990

[51] Int. Cl.[5] ..... A43C 9/00

[52] U.S. Cl. ..... 24/715.3; 24/715.4

[58] Field of Search ..... 24/715.3, 715.4, 715.5, 24/715.6

[56] References Cited

U.S. PATENT DOCUMENTS

| | | | |
|---|---|---|---|
| 742,164 | 10/1903 | Chapman | 24/715.4 |
| 772,338 | 10/1904 | Chandler | 24/715.4 |
| 1,172,328 | 2/1916 | Wardwell | 24/715.4 |
| 1,513,871 | 11/1924 | Staniewicz | 24/715.3 |
| 1,533,964 | 4/1925 | Berman | 24/715.3 |
| 1,767,732 | 6/1930 | Breadon | 24/715.3 |
| 1,770,786 | 7/1930 | Kohler | 24/715.3 |
| 1,804,211 | 5/1931 | Daniels et al. | 24/715.4 |
| 2,869,205 | 1/1959 | Kacowski | 24/715.3 |
| 4,423,539 | 1/1984 | Ivanhoe | 24/715.3 |

*Primary Examiner*—Victor N. Sakran

*Attorney, Agent, or Firm*—Andrus, Sceales, Starke & Sawall

[57] ABSTRACT

A shoe lace for use in athletic shoes includes an elongated strip of cloth covered elastic strands woven into a tubular configuration having a pair of oppositely disposed elongated straight sections that are connected by a pair of curved sections.

3 Claims, 1 Drawing Sheet

SHOE LACE FOR ATHLETIC SHOES

BACKGROUND OF THE INVENTION

The present invention relates to shoe laces and more particularly, for a shoe lace specifically adapted for use in an athletic shoe.

Athletic shoes and more particularly running shoes typically utilize a standard lacing system for securing the shoe to the foot of the wearer. Recently, the standard lacing system has been replaced in some shoes with velco strips. However, both of these systems have the disadvantage in that they do not stretch so as to provide give or movement during running or jumping by the wearer.

It is an object of the present invention to provide a shoe lace that will expand and contract along its length in response to the forces applied to it by the foot of the wearer.

SUMMARY OF THE INVENTION

A shoe lace for use in an athletic shoe includes an elongated strip formed of braided elastic strands that are woven into a tubular configuration. In accordance with one aspect of the invention, the tubular configuration has a pair of oppositely disposed elongated straight sections that are connected by a pair of curved sections disposed at opposite ends of the straight sections.

In accordance with yet another aspect of the invention, the shoe lace is formed of braided elastic that is capable of resiliently stretching at least seventy per cent beyond its original length.

In accordance with still another aspect of the invention, the lace is formed from forty-four elastic strands.

The present invention thus provides a shoe lace that firmly secures the athletic shoe to the foot of the wearer and yet is capable of expanding and contracting in response to the forces generated by the moving foot inside the shoe.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
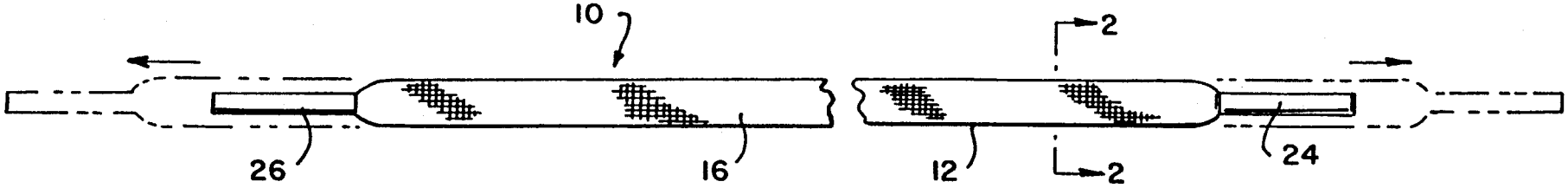
FIG. 1 is a plan view of a shoe lace constructed according to the invention with the stretching of the shoe lace shown in phantom.
Figure 2:
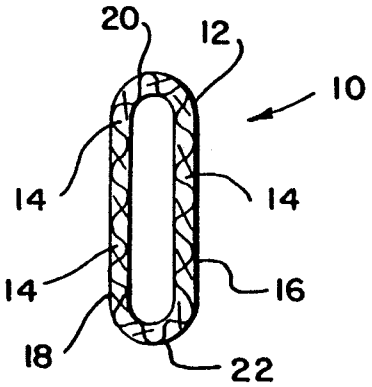
FIG. 2 is a sectional view along the line 2—2 of FIG. 1.

As shown in FIGS. 1 and 2, a shoe lace 10 is comprised of an elongated strip 12 that is formed by weaving cloth covered elastic strands 14 into a tubular configuration. Elastic strands 14 are well known in the clothing industry and are typically rubber strands with a cotton or polyester blend covering. This material is typically used in clothing in which a degree of elasticity or stretch is required such as in waistbands.

Shoe lace 10 utilizes forty-four elastic strands that are woven to form the tubular configuration. The tubular configuration of lace 10 includes a pair of oppositely disposed elongated straight sections 16 and 18 that are integrally connected by a pair of oppositely disposed curved sections 20 and 22 disposed at opposite ends of straight sections 16 and 18.

A pair of plastic tips 24 and 26 are disposed at opposite ends of elongated strip 12 so as to provide a reduced cross-sectional dimension for lace 10 at its ends to facilitate the lacing of the shoe.

Lace 10 utilizes elastic strands 14 that enable the stretching of lace 10 to at least seventy per cent beyond its original length.

The present invention thus provides a shoe lace that will stretch and contract in response to the forces generated by the wearer's foot inside the shoe.

Various modes of carrying out the invention are contemplated as being within the scope of the following claims particularly pointing out and distinctly claiming the subject matter which is regarded as the invention.

I claim:

1. A shoe lace for use in an athletic shoe, said lace being stretchable along its entire length and comprising a plurality of rubber strands, each of said strands being individually covered by a textile material, said covered rubber strands being woven into a hollow tubular configuration having a pair of straight planar sections along substantially its entire length with said straight planar sections integrally connected by a pair of curved sections disposed at opposite sides of said straight sections, plastic tip at each end of the strip to provide a reduced cross-sectional dimension for the lace ends; and the entire length of the lace is stretchable.

2. The shoe lace defined in claim 1 wherein said shoe lace is capable of resiliently stretching at least seventy per cent beyond its original length.

3. The shoe lace defined in claim 1 wherein said lace comprises forty-four of said elastic strands.

* * * * *

UNITED STATES PATENT AND TRADEMARK OFFICE

CERTIFICATE OF CORRECTION

PATENT NO. : 5,023,982

DATED : June 18, 1991

INVENTOR(S) : Charles T. Mehan

It is certified that error appears in the above-identified patent and that said Letters Patent is hereby corrected as shown below:

In Col. 2, L44-47: Delete "plastic tip at each end of the strip to provide a reduced cross-sectional dimension for the lace ends; and the entire length of the lace is stretchable" and substitute therefor --- wherein said shoe lace further comprising a plastic tip disposed on each end of said strip so as to provide a reduced cross-sectional dimension for said lace at said ends---

Signed and Sealed this

Sixth Day of April, 1993

*Attest:*

STEPHEN G. KUNIN

*Attesting Officer*

*Acting Commissioner of Patents and Trademarks*